US009781959B2

(12) United States Patent
Pimentel de Oliveira et al.

(10) Patent No.: US 9,781,959 B2
(45) Date of Patent: Oct. 10, 2017

(54) GLOVE HAVING DURABLE ULTRA-THIN POLYMERIC COATING

(71) Applicant: Ansell Limited, Richmond, Victoria (AU)

(72) Inventors: Geraldo Alexandre Pimentel de Oliveira, Coimbra (PT); Marco Antonio Francisco Costa, Vila Nova de Poiares (PT); Maria Ines Quaresma Ribeiro Campos, Vila Nova de Poiares (PT); Paulo Alexandre Gonçalves Francisco, Vila Nova de Poiares (PT)

(73) Assignee: Ansell Limited, Victoria (AU)

( * ) Notice: Subject to any disclaimer, the term of this patent is extended or adjusted under 35 U.S.C. 154(b) by 288 days.

(21) Appl. No.: 14/745,993

(22) Filed: Jun. 22, 2015

(65) Prior Publication Data

US 2015/0374052 A1 Dec. 31, 2015

Related U.S. Application Data

(60) Provisional application No. 62/017,520, filed on Jun. 26, 2014.

(51) Int. Cl.

| | |
|---|---|
| ***A41D 19/00*** | (2006.01) |
| ***D06M 15/564*** | (2006.01) |
| ***D06N 3/14*** | (2006.01) |
| ***A41D 19/015*** | (2006.01) |
| ***D06M 15/693*** | (2006.01) |

(Continued)

(52) U.S. Cl.

CPC ..... *A41D 19/0065* (2013.01); *A41D 19/001* (2013.01); *A41D 19/0006* (2013.01); *A41D 19/01505* (2013.01); *A41D 19/01558* (2013.01); *D06M 15/564* (2013.01); *D06M 15/693* (2013.01); *D06N 3/0009* (2013.01); *D06N 3/144* (2013.01); *D06M 15/31* (2013.01); *D06M 2200/35* (2013.01); *D06N 2209/105* (2013.01); *D06N 2211/103* (2013.01)

(58) Field of Classification Search

CPC ..... A47B 21/06; A47B 2200/0082; A41D 19/0006; A41D 19/001; A41D 19/0065; A41D 19/01505; A41D 19/01558; D06N 2209/105; D06N 2211/103; D06N 3/0009; D06N 3/144; D06M 2200/35; D06M 15/564; D06M 15/693

See application file for complete search history.

(56) References Cited

U.S. PATENT DOCUMENTS

| | | | |
|---|---|---|---|
| 3,689,613 | A | 9/1972 | Talalay |
| 6,051,320 | A | 4/2000 | Noecker et al. |

(Continued)

FOREIGN PATENT DOCUMENTS

| | | | |
|---|---|---|---|
| EP | 0592175 | B1 | 12/1997 |
| EP | 1060680 | A2 | 12/2000 |

OTHER PUBLICATIONS

"Latex Coated String Knit Gloves", http://www.uline.com/BL_6580/Latex-Coated-String-Knit-Gloves.

(Continued)

*Primary Examiner* — Arti Singh-Pandey

(74) *Attorney, Agent, or Firm* — Moser Taboada

(57) ABSTRACT

A thin, abrasion resistant supported glove, including a knitted liner and a polymeric layer disposed on and within individual strands of yarns of the knitted liner, are disclosed. Methods for manufacturing the thin, abrasion resistant supported glove are also disclosed.

20 Claims, 7 Drawing Sheets

(51) Int. Cl.
*D06N 3/00* (2006.01)
*D06M 15/31* (2006.01)

(56) References Cited

U.S. PATENT DOCUMENTS

| | | | |
|---|---|---|---|
| 7,971,275 | B2 | 7/2011 | Saunders et al. |
| 8,137,606 | B2 | 3/2012 | Thompson et al. |
| 8,367,168 | B2 | 2/2013 | Flather et al. |
| 8,522,363 | B2 | 9/2013 | Hassan et al. |
| 8,640,504 | B2 | 2/2014 | Thompson et al. |
| 2004/0221364 | A1 | 11/2004 | Dillard et al. |
| 2012/0240308 | A1 | 9/2012 | Thompson et al. |
| 2013/0213094 | A1 | 8/2013 | Moreland et al. |
| 2014/0000006 | A1 | 1/2014 | Perera et al. |
| 2014/0173805 | A1 | 6/2014 | Hassan et al. |

OTHER PUBLICATIONS

"12 Pairs String Knit Blue Latex Coated Palm Gloves—Size Large", http://www.gloveslegend.com/detail.php?pid=4098.
"Wonder Gloves®", http://www.northernsafety.com/Product/4556/Wonder-Gloves-Rubber-Palm-Coated-String-Knit-Work-Gloves.

SN-14-0811-T60-50X-EXTERIOR SURFACE

SN-14-0811-T0-50X-CROSS SECTION-2

SN-14-0811-T60-50X-EXTERIOR SURFACE-2

GLOVE HAVING DURABLE ULTRA-THIN POLYMERIC COATING

CROSS-REFERENCE TO RELATED APPLICATIONS

This application claims the benefit of priority to U.S. Appl. No. 62/017,520, which is herein incorporated by reference in its entirety.

BACKGROUND

Field

Embodiments of the present invention generally relate to gloves and, more particularly, to supported gloves comprising a knitted liner and a thin polymeric coating having enhanced abrasion resistance and methods of fabricating supported gloves having a thin polymeric coating.

Description of the Related Art

Gloves are used in many industries, such as construction, industrial, and other industries, as well as households, to protect the hands of users. Many such gloves comprise a fabric liner and a rubber material disposed thereon as a coating. However, although these gloves offer some protection, such gloves are not particularly flexible, which tire the hands of wearers during use and particularly extended use, causing repetitive motion injuries and other accidents due to hand fatigue. Moreover, gloves made with rubbers are often over-engineered, i.e., thicker liners and thicker coatings, to provide adequate physical properties, further decreasing comfort and flexibility. Also, it is difficult to adhere rubber coatings to a fabric liner and even more difficult to adhere thin rubber coatings to a fabric liner without strike-through, i.e., where the rubber extends from one surface of the fabric liner to the other surface of the fabric liner, undesirably contacting the hands of a wearer during use.

Therefore, the inventors have invented thin, abrasion resistant, supported gloves, and processes capable of fabricating thin, abrasion resistant, supported gloves.

SUMMARY

Thin, abrasion resistant supported gloves comprising a knitted liner made of one or more yarns and a polymeric composition disposed on the liner as a thin polymeric coating that penetrates the yarns providing enhanced durability, and methods for manufacturing thin, abrasion resistant supported gloves having a thin polymeric coating, substantially as shown in and/or described in connection with at least one of the figures disclosed herein, are disclosed as set forth more completely in the claims. Various advantages and features of the present invention will be more fully understood from the following description and drawings. The foregoing summary is not intended, and should not be contemplated, to describe each embodiment or every implementation of the present invention. The Detailed Description and exemplary embodiments therein more particularly exemplify the present invention.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments. It is to be understood that elements and features of one embodiment may be in other embodiments without further recitation. It is further understood that, where possible, identical reference numerals have been used to indicate comparable elements that are common to the figures.

DETAILED DESCRIPTION

Embodiments of the present invention comprise thin, durable supported gloves having thin, abrasion-resistant coatings disposed thereon. For example, gloves made in accordance with embodiments of the invention are capable of attaining EN388 level 4 abrasion resistance. Supported gloves, comprising a knitted liner and a thin polymeric coating disposed on the knitted liner, further comprise polymeric compositions, such as a low total solids content (TSC) mixture of nitrile-butadiene, and in some cases, a highly-carboxylated nitrile-butadiene polymeric material and/or a water-based polyurethane polymeric material to form a polymeric composition for disposition as a thin coating on the thin, knitted liner.

Figure 1:
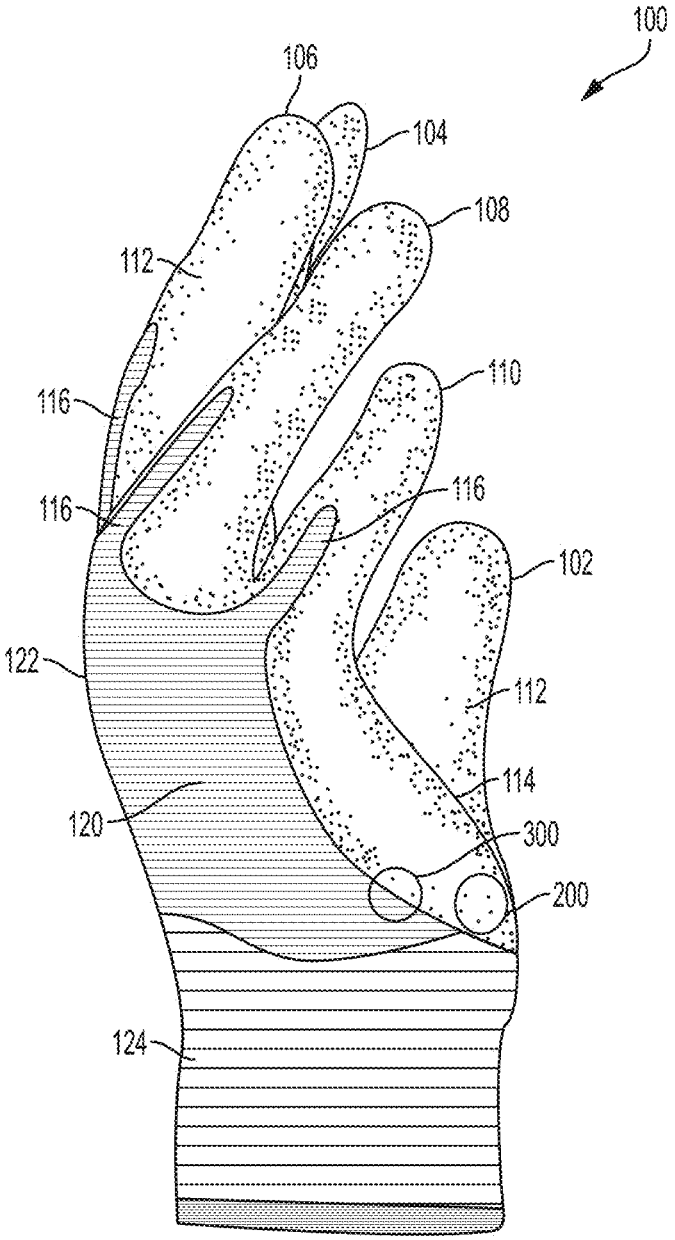
FIG. 1 depicts a perspective view of a drawing of a right-handed supported palm-dipped glove, in accordance with embodiments of the invention.

FIG. 1 depicts a perspective view of a drawing of a right-handed supported palm-dipped glove 100, in accordance with embodiments of the invention. The glove 100 comprises a knitted liner 120 having a thumb 102 and fingers 104, 106, 108, and 110, and optionally comprises a cuff 124. A polymeric coating 112 on the knitted liner 120 may comprise a palm dip (as shown), knuckle dip (in which a coating covers all knuckles of the back of the hand), finger dip (in which a coating covers the backs of the thumb and fingertips), three-quarters dip (in which the polymeric coating 112 is disposed on the palm 114 and the fingers 102, 104, 106, 108, and 110 and knuckles 116, though the backhand area 122 is uncoated), full dip (in which substantially all of the knitted liner 120 is coated), and the like as needed for specific applications using the dip processes as described in commonly assigned U.S. Pat. No. 7,814,571, which is incorporated herein by reference in its entirety. FIG. 1 shows the glove 100 having a palm dip in which the palm 114 is totally covered with the polymeric coating 112. The palm side of fingers 102, 104, 106, 108, and 110 are covered. The polymeric coating 112, which may be formed using the polymeric composition as described below in Table 1, partially covers the backside of the fingers 102, 104, 106, 108, and 110, while the back hand side 122 of the right-handed glove 100 is uncoated, leaving the knitted liner 120 partially exposed.

Figure 2:
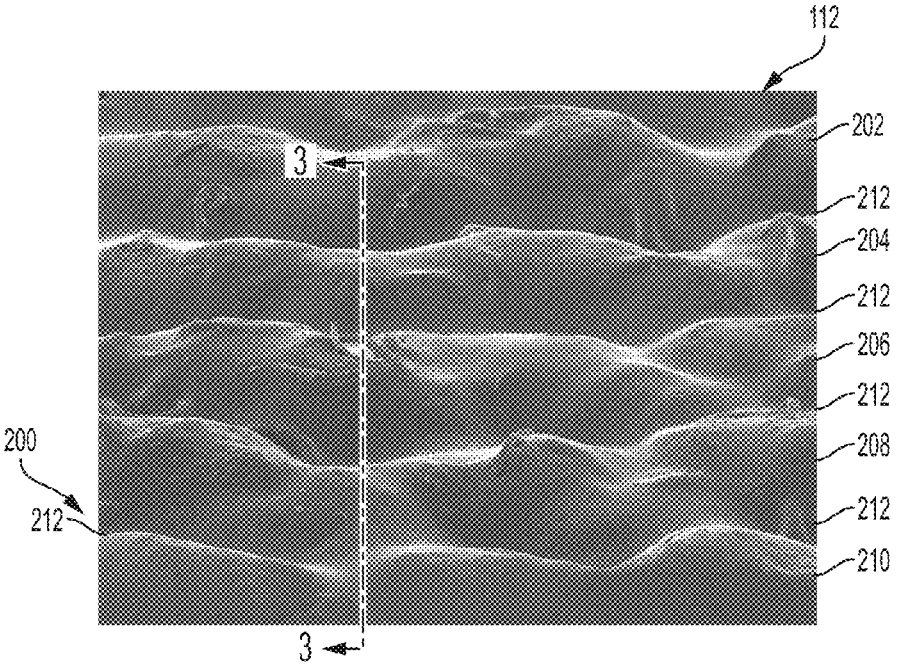
FIG. 2 is a SEM image of a close up view of an exterior surface, taken at a 60° angle from the horizontal, showing a thin polymeric coating disposed on strands of a yarn, such as the glove depicted in FIG. 1, according to embodiments of the invention.

FIG. 2 is a SEM image of a close up view 200 of an exterior surface, taken at a 60° angle from the horizontal, showing a thin polymeric coating 112 disposed on strands of a yarn, such as the glove depicted in FIG. 1, according to embodiments of the invention. The knitted liner 120 comprises rows 202, 204, 206, 208, and 210 which are shown horizontally, which are called courses when referring to an uncoated knitted liner (not shown). Between the rows 202, 204, 206, 208, and 210 are interstices 212. As can be seen, the polymeric coating 112 is thin enough that the interstices 212 are not completely filled with the polymeric coating 112, indicating that a thickness of the polymeric coating 112 on top of the rows is at least less than half the diameter of the yarns. In other words, if the polymeric coating 112 was thicker, the interstices 212 between the rows 202, 204, 206, 208, and 210 could not be seen because the exterior surface of the polymeric coating 112 would appear as essentially a flat surface. An average diameter for a strand of yarn, for example, a 280 denier yarn, is approximately 0.19 mm, which would be knitted, typically, with a 15 gauge needle. For knitted articles, such as the knitted liner 120, two yarns overlap and therefore, the thickness at that point, before compressing or compaction is 0.38 mm. Other knitted articles, using other deniers, are also contemplated. For example, two ends of 2 ply/70 denier/34 filament with each filament having a denier of 2.08 have a total nominal denier of 280, which is suited for knitting with a 15-gauge needle to produce a knitted liner. A knitted liner prepared from such a yarn has a measured uncompressed thickness of 1.34 mm and a compressed thickness under 9 ounce (225 grams) load of 1.13 mm using an Ames Logic basic thickness gauge model no. BG1110-1-04, according to ASTM D1777. Another example according to embodiments of the invention comprises a 140 denier yarn, having a diameter of approximately 0.13 mm, which would be knitted, typically, with an 18 gauge needle. The thickness of such a knitted liner, before compressing or compaction, is 0.26 mm. Coating a knitted liner with a polymeric composition, as described above, tends to provide a knitted liner having a thickness approximating a compressed thickness.

As shown, the polymeric coating 112 penetrates the single yarn strand by approximately 0.01 mm, which is approximately 5-50% of the thickness of the strand of the yarn. For example, a 140 denier yarn would be covered with 0.01 mm on each side of the knitted liner for a total thickness of approximately 0.28 mm. In other words, the thickness of the knitted liner 120 before the polymeric coating 112 is applied is, for example, 0.28 mm. However, measurements have shown that after the polymeric coating 112 is applied, the thickness of the coated liner is 0.24 mm. Accordingly, as discussed below, the knitted liner 120 compacts, i.e., becomes thinner. For example, if the polymeric coating 112 could be stripped from the knitted liner 120, the knitted liner 120 would be 0.22 mm in thickness, i.e., a "negative thickness" of 0.02 mm, i.e., shrinkage, results from applying the thin polymeric coating 112 to the knitted liner 120. In other words, the knitted liner 120 shrinks more than the thickness of the polymeric coating 122 disposed thereon. In some cases, depending on the type and denier of the yarns comprising the knitted liner 120, a negative thickness of 0.1 mm may result. For example, at least one exemplary embodiment of the invention comprises a 15 gauge knitted liner comprising nylon and an elastomeric filament, for example, LYCRA®, SPANDEX®, or ELASTANE®, which is 0.9 mm thick and exhibits a negative thickness of 0.1 mm. Additionally, at least one exemplary embodiment of the invention comprises an 18 gauge knitted liner comprising nylon that is 0.69 mm thick and when undergoing the disposition of a polymeric composition, also results in a 0.1 mm reduction in thickness, in this case from 0.69 mm to 0.59 mm.

In some embodiments of the invention, as discussed more fully below, any liner discussed herein, including but not limited to the knitted liner 120, is dipped in, or otherwise has applied thereto, a 25% aqueous solution of calcium nitrate and a surfactant while in other embodiments the coagulant comprises a 7% aqueous solution of calcium nitrate and a surfactant. Similarly, in some exemplary embodiments of the invention, any liner discussed herein is dipped into an alcohol solution comprising acetic acid and a surfactant, such as SURFYNOL® 465. In at least one embodiment of the invention, the coagulant solution comprises a concentration of 30-60%, having approximately equal amounts of acetic acid and calcium nitrate in water and ethyl alcohol and 0.1-0.5% SURFYNOL®. Such a mixed coagulant helps the adhesion of any polymeric coating discussed herein to the knitted liner because of its wetting characteristics, resulting in less delamination or peeling.

Figure 3:
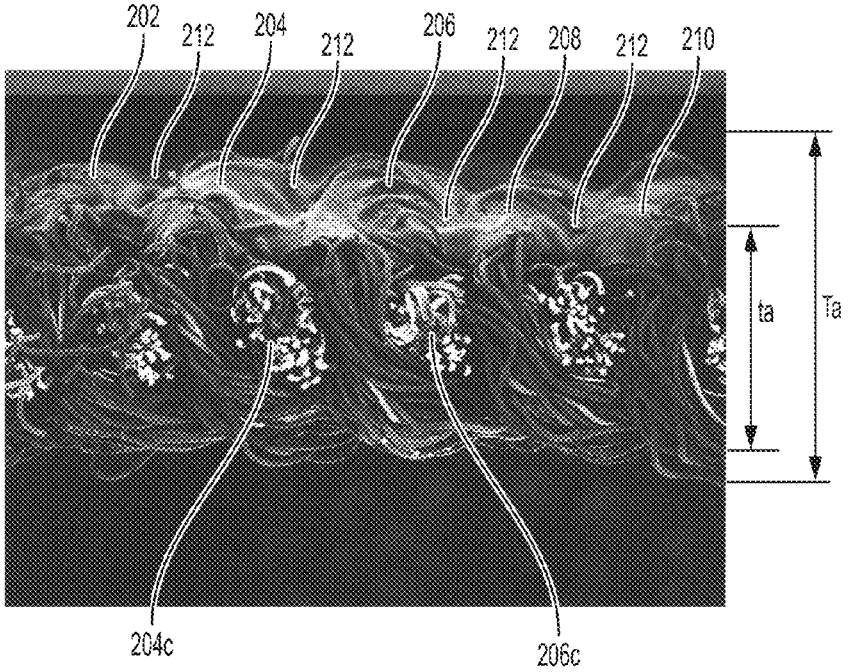
FIG. 3 is a cross section taken along line 3-3 of the SEM of FIG. 2, showing a knitted liner having the polymeric coating penetrating the yarns comprising the knitted liner; in accordance with embodiments according to the invention.

FIG. 3 is a cross section taken along line 3-3 of the SEM of FIG. 2, showing a knitted liner 120 having the polymeric coating 112 penetrating yarns comprising the knitted liner 120; in accordance with embodiments according to the invention. The polymeric coating 112 nominally penetrates the interstices 212 between rows 202, 204, 206, 208, 210 of yarns comprising the knitted liner 120. As can be seen, the overall thickness $T_a$ across rows of yarns is less than the overall thickness $t_a$ across the interstices. It is further seen that at the center of the knitted liner 120, for example, areas 206*c* and 204*c*, the polymeric coating 112 does completely penetrate, leading to a glove 100 having even greater flexibility.

Figure 4:
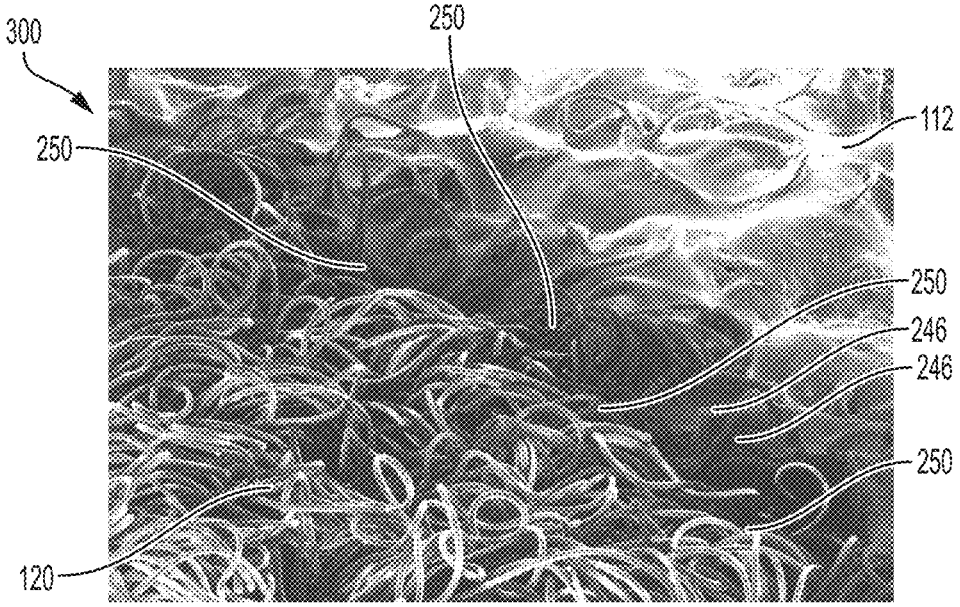
FIG. 4 is a SEM close up view of the exterior surface, at an interface where no polymeric coating penetrates the strands of the yarn comprising the liner of the glove depicted in FIG. 1, in accordance with embodiments according to the invention.

FIG. 4 is a SEM close up view 300 of the exterior surface, at an interface 250 where no polymeric coating 112 penetrates strands of the yarn comprising the knitted liner 120 of the glove depicted in FIG. 1, in accordance with embodiments according to the invention. As shown, individual strands of yarns 246 comprising the knitted liner 120 can be seen under the polymeric coating 112, supporting the fact that the polymeric coating 112 is very thin.

The penetration and gelling action of the polymeric composition into the knitted liner 120, such as the polymeric composition described below in Table 1, is a function of the viscosity of the polymeric composition and the velocity of the dipping (for example, of a former having a liner, such as the knitted liner 120, disposed thereon) into a polymeric composition tank, as discussed below. The faster the coagulant coated knitted liner on the former is immersed into the tank, the higher the hydrostatic pressure, and, therefore the polymeric composition penetrates more quickly into yarns strands of the knitted liner 120. When the immersion velocity is small and the viscosity of the polymeric composition is high, the polymeric composition minimally penetrates the knitted liner 120 resulting in less adhesion of the polymeric coating 112. Therefore, at least two controllable process variables are available for reliably controlling the penetration of the polymeric composition into the knitted liner 120, i.e., "strikethrough," even when the knitted liner 120 is relatively thin with other factors being consistent, i.e., similar polymeric composition and pre-coagulant formulation.

Without intending to be bound by theory, at least one reason that gloves according to embodiments of the invention exhibit enhanced abrasion resistance is that there is a lesser stretch delta between the areas of the knitted liner 120 having a polymeric coating 112 disposed thereon and those areas of the knitted liner 120 that do not have the polymeric coating 112 disposed thereon, which are separated at the interface 250. For example, when a user wears a glove, the yarns and coating of which a glove is comprised stretch, for example, during flexing or opening/closing of the hand or during the donning and doffing of the glove or when, for example, clutching hand tools. Such actions stretch all parts of a glove. However, the greater the difference when stretching coated (areas having a polymeric layer disposed thereon) areas and uncoated (no polymeric layer) areas, or when the liner stretches more than the coating, the more likely the coating on any glove can become delaminated from the liner. Gloves according to embodiments of the invention have a smaller stretch delta between these areas, resulting in less delamination of the polymeric coating 112 from the knitted liner 120 and therefore a greater abrasion resistance. It is further believed that the lessened total solids content of the polymeric composition, as discussed herein, allows penetration of the polymeric composition into the individual strands of yarns of the knitted liner 120.

In contrast, typical abrasion tests involve a static glove being abraded by an abrasive wheel. In other words, the abrasive wheel rotates on the glove but the yarns of the glove do not stretch and contract during testing and, therefore, the coating does not move or stretch with respect to the knitted liner as it would in-service. Such tests are therefore not necessarily indicative of the in-service environmental factors encountered, as discussed above. Gloves according to the present invention comprise the interstices 212, i.e., spaces between the loops and/or rows between the yarns of a knitted liner, which become larger and smaller during stretching, use, etc. However, the polymeric coating 112 disposed therebetween does not lose adherence to the yarns and therefore does not chip away during flexing. Embodiments of the invention further comprise where there is significant penetration of the polymeric material into and within individual strands of the yarn, which, in embodiments according to the invention, traps the polymeric material and is therefore not as easily delaminated from the yarns or abraded. Furthermore, there is not as much polymeric material in the interstices 212 of the knitted liner 120, which is not adhered to a yarn. And, because the difference in stretching between the uncoated areas of the liners and the coated areas of the liners is low, the polymeric coating 112 disposed between the interstices 212 is less likely to lose adherence. Another surprising result of this glove structure, for example, for a glove 100 comprising one polymeric coating 112, is that the glove 100 is breathable yet abrasion resistant. In some embodiments, the knitted liner 120 undergoes two dips into a polymeric composition, resulting in a still thin yet substantially liquid impermeable glove.

Figure 5:
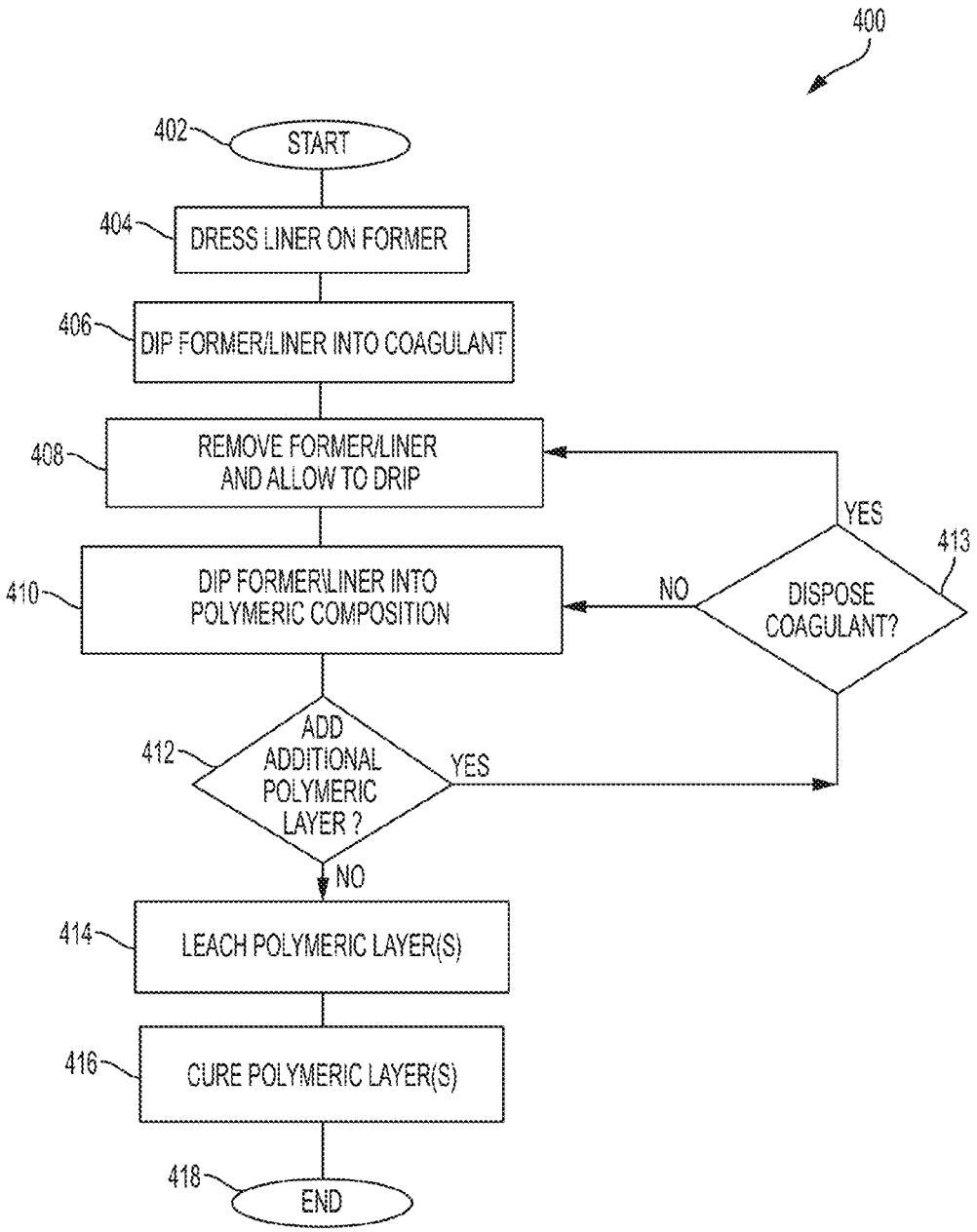
FIG. 5 depicts a flow diagram of a method for producing a thin, abrasion resistant, supported glove, in accordance with one or more embodiments of the invention.

FIG. 5 depicts a flow diagram of a method 400 for producing a thin, abrasion resistant, supported glove, in accordance with one or more embodiments of the invention. In some embodiments, each and every step of the method 400 is performed. In other embodiments, some steps are omitted or skipped. The method 400 starts at step 402 and proceeds to step 404, wherein a knitted liner is dressed on a former. At step 406, the former having the knitted liner dressed thereon is dipped into a tank having a coagulant solution, as discussed below. Optionally, the coagulant solution may be heated to 25-60° C. In some embodiments of the invention, the coagulant solution comprises, for example, a 30-60% acetic acid aqueous or alcoholic solution or another salt, such as a salt of calcium chloride, calcium citrate, and the like. The knitted liner may be dipped in one of several ways, such as a full-dip, a ¾ dip, a knuckle-dip, palm-dip or the like, as is discussed herein and as disclosed in commonly-assigned U.S. patent application Ser. No. 12/769,829, which is herein incorporated by reference in its entirety.

In some embodiments of the invention, the former at step 406 is dipped into the coagulant, as discussed above, without a knitted liner, which, when the rest of the method 400 is performed, forms an unsupported abrasion resistant coating on the former. At step 408, the former having the knitted liner is removed from the tank, and allowed to dry for approximately 1-10 minutes at room temperature, for example, 18-25° C. At step 410, the former and knitted liner are dipped into a tank having a polymeric composition, as described above, disposing a polymeric layer of the composition onto the knitted liner, i.e., an uncured polymeric coating. At step 412, the decision is made whether to add a second layer of polymeric composition (for example, to form a liquid impermeable glove, as discussed above) onto the polymeric layer disposed onto the knitted liner at step 410. If the answer is yes, the method 400 proceeds to step 413, where a decision is made whether to dispose coagulant onto the layer of polymeric composition disposed at step 410. If the answer is no, the method 400 returns to step 410. If the answer is yes, the method 400 returns to step 406. In some embodiments of the invention, the second layer of polymeric composition is thicker than the layer of polymeric composition that is disposed onto the knitted liner. A supported glove having two layers of polymeric composition, according to embodiments of the invention, with the negative thickness described above, is favorably compared with a conventional supported glove having two layers of a polymeric composition because the reduced thickness results in a more flexible glove that also has additional tactile sensitivity. Accordingly, because the first polymeric composition promotes a negative thickness, the disposition of a second polymeric composition thereon results in a glove that is thinner compared with other glove liners having two polymeric coatings disposed thereon. Furthermore, a second polymeric layer provides a very thin, flexible, abrasion resistant glove that is also liquid proof.

If no second layer of polymeric composition is to be disposed, the method 400 proceeds to process step 414, wherein the glove is leached of impurities and proteins, for example, by washing in water at approximately 35-50° C. for approximately 1-3 minutes. The polymeric coatings on the knitted liner are optionally allowed to dry in ambient air. At step 416, the glove is placed in an oven for curing, for example, at 80-140° C. for 20 to 40 minutes. At step 418, the method 400 ends. The method 400 automatically compacts the knitted liner, wherein compacting is defined as a shrinking of the knitted liner and increases the density of the knitted liner. Moreover, in some embodiments of the invention, the knitted liner having the polymeric coating disposed thereon becomes thinner than the knitted liner before undergoing the method 400.

Figure 6:
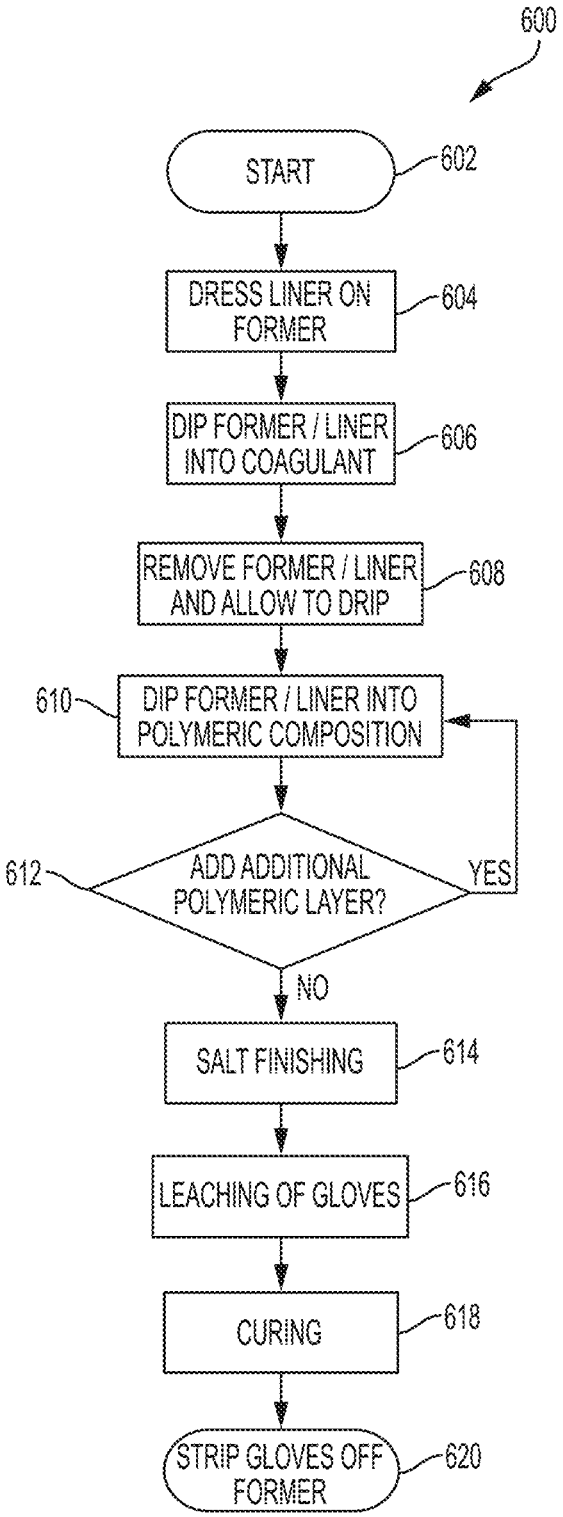
FIG. 6 depicts a second flow diagram of a method for producing a thin, abrasion resistant, supported glove, in accordance with one or more embodiments of the invention.

FIG. 6 depicts a second flow diagram of a method 600 for producing a thin, abrasion resistant, supported glove, in accordance with one or more embodiments of the invention. The method 600 starts at step 602 and proceeds to step 604, wherein a knitted liner, such as a knitted or woven fabric liner, is dressed on a former. At step 606, the former having the liner dressed thereon is dipped into a tank having a coagulant solution, as discussed below. Optionally, the coagulant solution may be heated to, for example, 25-60° C. In some embodiments of the invention, the coagulant solution comprises, for example, a 30-60% acetic acid solution in water. The liner may be dipped in one of several ways, such as a full-dip, a ¾ dip, a knuckle-dip, palm-dip or the like, as is discussed herein and as disclosed in commonly-assigned U.S. patent application Ser. No. 12/769,829, which is herein incorporated by reference in its entirety.

At step 608, the former is removed from the tank, and allowed to drip dry for approximately 1-10 minutes at room temperature, for example, 18-25° C. At step 610, the former and liner are dipped into a tank having a polymeric composition, as described above, disposing a polymeric layer of the composition onto the liner. At step 612, the decision is made whether to add a second layer of polymeric composition (for example, to form a liquid impermeable glove, as discussed above) onto the polymeric layer disposed onto the liner at step 610. If the answer is yes, the method 600 goes to step 610, and an additional layer of polymeric composition is disposed thereon. In some embodiments of the invention, the second layer of polymeric composition comprises a different polymeric composition (a first polymeric layer may be polyurethane, polychloroprene, a polyurethane/nitrile-butadiene blend and the like and the second layer may comprise the same or a different polymeric composition) or is thicker than the layer of polymeric composition that is disposed onto the liner. A supported glove having two layers of polymeric composition, according to embodiments of the invention, with the negative thickness described above, is favorably compared with a conventional supported glove having two layers of a polymeric composition because the reduced thickness results in a more flexible glove that also has additional tactile sensitivity.

If no second layer of polymeric composition is to be disposed, the method 600 proceeds to process step 614 to undergo a salt finishing step. For example, the liner having the polymeric composition disposed thereon as a polymeric coating may be dipped into a salt fluidized bed comprising one or more of, for example, sodium sulfate, sodium chloride, or other sodium salts, embedding salt particles into the polymeric coating. At step 616, the glove is leached of impurities and proteins, for example, by washing in water at approximately 35-50° C. for approximately 1-3 minutes, which also dissolves the salt particles and leaves multi-faceted indentations therein, providing a rough texture that improves the grip properties of the glove, particularly in wet or oily environments. The polymeric coating(s) on the liner are optionally allowed to dry in ambient air. At step 618, the glove is placed in an oven for curing, for example, at 80-140° C. for 20 to 40 minutes. At step 620, the gloves made from the method 600 are stripped from the former and the method 600 ends. The method 600 automatically compacts the liner, as above. Also, in some cases, the leaching step 616 occurs after the curing step 618.

Figure 7:
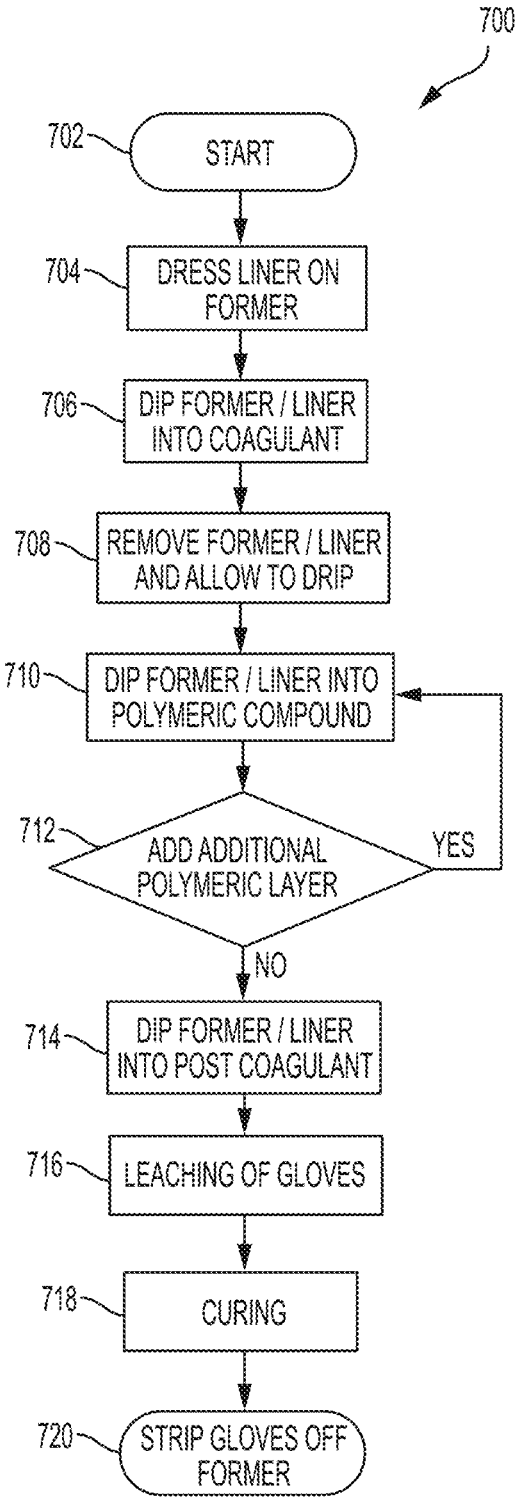
FIG. 7 depicts a third flow diagram of a method for producing a thin, abrasion resistant, supported glove, in accordance with one or more embodiments of the invention.

FIG. 7 depicts a third flow diagram of a method 700 for producing a thin, abrasion resistant, supported glove, in accordance with one or more embodiments of the invention. The method 700 starts at step 702 and proceeds to step 704, wherein a knitted liner, such as a knitted or woven fabric liner, is dressed on a former. At step 706, the former having the liner dressed thereon is dipped into a tank having a coagulant solution, as discussed below. Optionally, the coagulant solution may be heated to, for example, 25-60° C. In some embodiments of the invention, the coagulant solution comprises, for example, a 30-60% acetic acid solution in water. The liner may be dipped in one of several ways, such as a full-dip, a ¾ dip, a knuckle-dip, palm-dip or the like, as is discussed above.

At step 708, the former is removed from the tank, and allowed to drip dry for approximately 1-10 minutes at room temperature, for example, 18-25° C. At step 710, the former and liner are dipped into a tank having a polymeric composition, as described above, disposing a first polymeric coating onto the liner. At step 712, the decision is made whether to add a second layer of polymeric composition (for example, to form a liquid impermeable glove, as discussed above) onto the polymeric layer disposed onto the liner at step 710. If the answer is yes, the method 700 returns to step 710, and an additional layer of polymeric composition is disposed thereon. In some embodiments of the invention, the second polymeric coating is thicker than a first polymeric coating that is disposed onto the liner. As above, a supported glove having two layers of polymeric composition having a negative thickness is favorably compared with a conventional supported glove having two polymeric layers because the reduced thickness results in a more flexible glove that exhibits additional tactile sensitivity.

If no second layer of polymeric composition is to be disposed as a second polymeric coating, the method 700 proceeds to step 714 wherein the former and liner are dipped into a post coagulant. For example, the coagulant comprises an aqueous solution of calcium chloride or calcium citrate, of approximately 2-15% concentration, into which the former and liner are dipped for approximately 1-10 minutes. At step 716, the liner having the polymeric coating disposed thereon is leached of impurities and proteins, as discussed above. The polymeric coatings, i.e., layer(s) of polymeric composition on the liner are optionally allowed to dry in ambient air. At step 718, the liner having the polymeric coating(s) is placed in an oven for curing, for example, at 80-140° C. for 20 to 40 minutes, producing a thin, abrasion resistant, supported glove. At step 720, the thin, abrasion resistant, supported glove made from the method 170 are stripped from the former and the method 700 ends. As above, the method 700 automatically compacts the liner.

In at least one embodiment of the invention of the methods 400, 600, and/or 700, a knitted liner, for example, a 13, 15, or 18-gauge knitted liner, comprising yarns having a denier ranging from, for example, 70-400, is knitted using a nylon yarn and dressed on a hand shaped ceramic or metallic former. An 18-gauge knitted liner, knitted with at least one 18-gauge needle, is effective at producing knitted liners having smaller interstices between yarns. Also, 18-gauge needles can knit yarns of a lesser denier (for example, for any given yarn, a lower denier indicates a smaller diameter) than 13 and 15-gauge needles, allowing for thinner, more flexible knitted liners. For example, a 15 gauge needle is capable of knitting a 329 denier yarn, an 18-gauge needle is too small to knit that large a yarn. One of ordinary skill in the art would not knit a yarn larger than 221 denier using an 18-gauge needle. Nor would there be any reason to knit a 221 denier yarn using a 15-gauge needle, which would create large interstices, which would otherwise promote increased, and unfavorable, strikethrough during dipping processes. Additional strikethrough in this context would result in even more of the polymeric composition being disposed on and in between the yarns of the liner, which would allow even greater amounts of abrading during use.

The processes, such as the methods 400, 600, and/or 700, in accordance with embodiments of the invention, comprise the step of dipping a knitted liner dressed on a former, into a coagulant, next dipping the knitted liner on the former into either a low or high total solids content (TSC) polymeric composition comprising a mixture of polyurethane and nitrile-butadiene to form a supported glove, as discussed below. The viscosity of the polymeric composition and the TSC are independent of each other, however, without intending to be bound or limited by theory, it is believed that and the acetic acid coagulant, acts rapidly and promotes the quick expelling of water in the polymeric composition, as opposed to other coagulants, which are more hygroscopic. Also, the increased amount of crosslinking is believed to provide the enhanced durability exhibited by the glove. Moreover, because the composition has a low viscosity, it penetrates into the fibers of the yarns, becoming trapped there, leading to a further increase in durability from abrasion.

Figure 8:
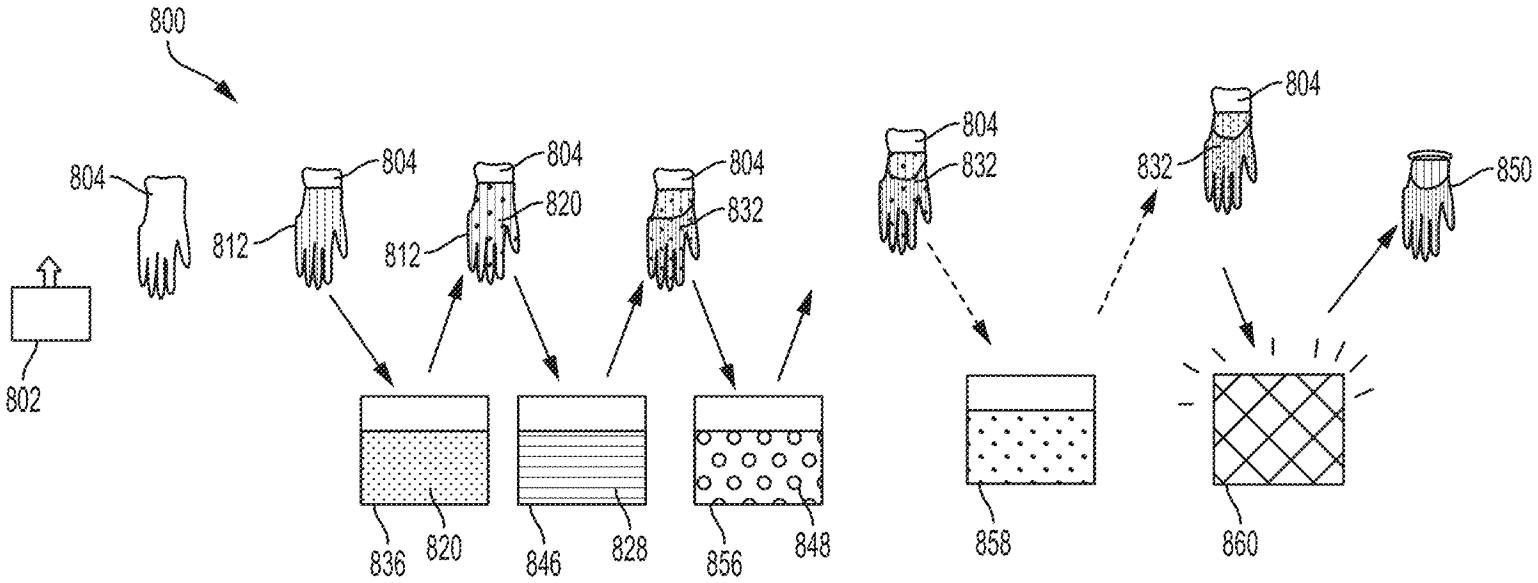
FIG. 8 depicts a diagram of a method and apparatus for producing a thin, abrasion resistant, supported glove comprising a knitted liner and a thin, polymeric layer disposed on the knitted liner, according to embodiments of the invention.

FIG. 8 depicts a diagram of a method and apparatus 800 for producing a thin, abrasion resistant, supported glove comprising a knitted liner 812 and a thin, polymeric coating 832 disposed on the knitted liner 812, according to embodiments of the invention. The apparatus 800 comprises a controller 802, which controls, for example, production line equipment, such as electronic circuits for controlling robots that deliver glove formers 804 to tanks 836, and/or an oven 860. A former 804 is provided. The former 804 has a knitted liner 812 dressed thereon is dipped into a tank 836 containing a coagulant 820, such as the aqueous or alcoholic (or aqueous/alcoholic mixture) coagulant as described herein, which becomes disposed on the knitted liner 812. The former 804 having the knitted liner 812 dressed thereon is removed from the tank 836 and allowed to dry, such as a drip dry.

The former 804 having the knitted liner 812 dressed thereon is then dipped into a tank 846, containing a polymeric composition 828, one such polymeric composition as indicated in Table 1, and is removed therefrom. The knitted liner 812 now has polymeric composition 828 disposed as an uncured polymeric coating 832 thereon. The knitted liner 812 having the uncured polymeric coating 832 is optionally delivered to a tank 856 containing water 848, for example, room temperature or hot water, in which the uncured polymeric layer 828 is leached of impurities and/or proteins. The water 848 may also remove part of the uncured polymeric coating 832, promoting adherence of subsequently disposed polymeric compositions as well as reducing a thickness of the uncured polymeric layer 832 disposed on the former 804.

The former 804 having the uncured polymeric layer 832 disposed thereon is then optionally delivered to a coagulant tank 858, which may contain the same coagulant within tank 836 or contain a different coagulant, such as a weaker acid solution, for example, a formic acid or acetic acid solution, into which the uncured polymeric layer 832 is dipped, which can promote a slow and more complete internal gelling of the uncured polymeric coating 832, allowing for a through-crosslinking as opposed to a case-hardened, i.e., surface crosslinking, which can enhance physical properties, such as abrasion and/or cut resistance.

The former 804 is then delivered to an oven 860, wherein the uncured polymeric layer 812 is cured with heat, as discussed above, to form a glove 850. The curing can be accomplished in two or more stages of varied temperatures and/or time periods, as discussed above. The glove 550 is then stripped from the former 804.

In at least one exemplary embodiment of the invention, the polymeric composition comprises a mixture of nitrile-butadiene (NBR), which may be a highly carboxylated NBR (such as 30% or more carboxylated) and water-based polyurethane (PU) as indicated in Table 1. In some embodiments of the invention, the PU is a polyester-based PU that reacts quickly with an acidic coagulant so there is little to no strikethrough of the polymeric composition to the knitted liner. Compositions according to the present invention comprise a ratio of 50-50% NBR to PU, 70-30% NBR to PU and, in at least one exemplary embodiment of the invention, the composition comprises a mixture of 90% NBR and 10% PU. Compositions further comprise a TSC between 25-40%. Moreover, in at least one exemplary embodiment of the invention, the TSC is approximately 35%.

TABLE 1

| Composition | Dry weight % |
|---|---|
| NBR-PU | 100 |
| Ammonia | 0.1-0.3 |
| Wax | 1.5-4.0 |
| Thickener | 0.1-0.80 |
| Color pigment (optional) | 0.2-1.0 |

Polymeric compositions according to the invention generally have a viscosity ranging from 650-850 centipoises, while in other embodiments of the invention, the viscosity ranges from 850-1100 centipoises. Compositions in accordance with embodiments of the invention also comprise commonly used stabilizers including but not limited to potassium hydroxide, ammonia or ammonium hydroxide, sulfonates, and the like as well as other commonly used components, such as surfactants, anti-microbial agents, waxes, such as polyethylene waxes or carnauba waxes, processing aids, and the like. In some embodiments, the compositions further comprise thixotropic agents and/or rheology or flow modifiers, such as acrylic-based flow modifiers, which can reduce the viscosity of the polymeric compositions, while maintaining stable polymeric compositions, thus allowing thinner polymeric coatings to be disposed onto and within fabric liners, such as the family of ACRYSOL® Rheology Modifiers, manufactured by The Dow Chemical Co. The addition of wetting agents and viscosity modifiers to the polymeric coating solution as known to those of ordinary skill in the art are also contemplated herein.

In addition to the polymeric compositions described above, in some embodiments, polymeric compositions may further comprise natural rubber latex or synthetic rubber latex, as well as other elastomeric polymer materials, for example, but not limited to, natural or synthetic polyisoprene, polychloroprene, polyvinyls, butyl latex, styrene-butadiene (SBR), styrene-butadiene latex, styrene-isoprene-styrene (SIS), styrene-ethylene/butylene-styrene (SEBS), styrene-acrylonitrile (SAN), polyethylene-propylene-diene, or solvent-based polyurethane, and the like, or mixtures or blends thereof.

Also, the polymeric compositions, as described above, further comprise fillers and/or reinforcements for strength and other enhancements of physical properties, such as silica, fumed silica, calcium carbonate, metallic and ceramic powders, glass-fibers, and the like to provide grip, texture, tensile strength, and abrasion- and heat-resistance. Such fillers and reinforcements can, for example, comprise between 1-20% of a material by weight, and can also promote the transfer of heat from the inside of the glove to the outside, resulting in greater comfort to the wearer. Other additives are added as needed, such as for arc-retardance, ultra-violet stabilization, hardness, pigments, adhesion promoters, and the like.

The polymeric composition may contain additional surfactants, for example, a polysorbate, such as TWEEN® 20, to stabilize the foamed polymeric composition. Once the polymeric composition is foamed with appropriate air content and the viscosity is adjusted, refinement of the foam is undertaken by using an impeller at a suitable speed as is known to those in the art. The polymeric coating, irrespective of whether foamed, may be applied by dipping a former, or a former having a knitted liner dressed thereon, into a polymeric composition or spraying the coating onto the knitted liner or, for unsupported gloves, dipping the former directly into the polymeric composition or spraying the former with the polymeric composition.

Liners, such as knitted liner 120, may be of the same yarn throughout, comprise different yarns in specified regions of the knitted liner or, alternatively, comprise various blends of fibers into one composite yarn to impart desirable properties. Gloves may also comprise a plaited structure, having a main yarn and a different yarn, typically of a smaller denier, stitched with the main yarn to form a multi-layered knitted structure. For example, some yarns are cut resistant, fire- and/or heat-resistant, hydrophilic, hydrophobic, or flexible. Cut resistant yarns comprise, for example, ultra high molecular weight polyethylene (UHMWPE), such as DYNEEMA®, TSUNOOGA®, a meta-aramid, such as NOMEX®, or a para-aramid, such as KEVLAR® or TWARON®. Low cost elastic yarns, such as LYCRA®, SPANDEX®, or ELASTANE® may be used to impart flexibility.

Abrasion resistant yarns are made from a material able to withstand the effects of wear. In some embodiments of the invention, abrasion resistant yarns include materials such as fiberglass, basalt fibers, steel, or other materials having a Mohs hardness of 3 or greater. Examples of abrasion resistant yarns include 2/70/34 textured nylon 66 filament and 2/70/34 textured nylon 6. In some embodiments of the invention, yarns comprise steel wire, glass fibers, nylons, aliphatic and aromatic nylons, SPECTRA®, VECTRAN®, and the like or any composite or blend of the fibers and materials, including cotton, rayon, polyester, polypropylene, and the like. In some embodiments, the knitted liner may be knitted by a Knitted Variable Stitch Design (KVSD) process, as described in commonly-assigned U.S. Pat. Nos. 6,962,064; 7,213,419; 7,246,509; and 7,434,422, which are herein incorporated by reference in their entireties, to add reinforcements or provide areas of lesser or greater stretching, for example in crotches between fingers or the index finger and the thumb.

Coagulant solutions, which destabilize and coagulate the polymeric composition, include aqueous- and/or alcohol-based solutions of acetic acid, and other coagulants, such as calcium nitrate, or mixtures of acetic acid and another coagulant(s), the concentration of which may be varied to produce coagulant solutions allowing thin polymeric layers to be disposed on the liners. In general, an acetic acid solution containing no calcium nitrate will produce a thinner polymeric layer on a liner. Also, if a liner is knitted from a thicker yarn, a coagulant solution comprising a higher concentration is used with some embodiments of the invention. For example, an aqueous solution comprising 4% acetic acid and 16% calcium nitrate may produce a coating thickness of approximately 0.15 mm. An aqueous solution comprising 15% acetic acid and 15% calcium nitrate produces a coating thickness of approximately 0.08 mm. An aqueous solution comprising 10% acetic acid and 10% calcium nitrate very unexpectedly produces a coating thickness of approximately 0.01 mm while an aqueous solution comprising 30-60% acetic acid produces a "negative" coating thickness of approximately minus 0.05 mm-0.10 mm. In other words, the thickness of the liner became smaller despite disposing a polymeric coating thereon. In fact, the polymeric coating becomes mechanically entrapped within the yarn but presents only a small amount on the surface of the yarn, as discussed herein. An additional surprising result is that a supported glove comprising a thin 18-gauge knitted liner and a thin polymeric coating disposed thereon achieves an EN4 abrasion resistance.

Additional coagulant solutions comprise one or more salts, such as calcium nitrate, calcium chloride, sodium chloride, potassium chloride, aluminum chloride, aluminum sulfate, and like salts, as well as acids, such as tricarboxylic acid. At least one exemplary embodiment of the invention comprises a mixture of calcium nitrate and acetic acid. Any of the aforementioned coagulants are highly soluble in water. The coagulant solution possesses adequate surface-wetting properties and sufficient viscosity or rheology characteristics so as to penetrate the knitted liner. In some embodiments, the application of the weak coagulant is followed by the application of a strong coagulant. It is believed that an increase in crosslinking results in significant and unexpected increases in abrasion resistance.

Embodiments of at least one method of manufacturing a polymeric article, according to embodiments of the invention, comprise disposing a coagulant on a former, the former having at least two regions; dipping the coagulant coated former into a non-foamed polymeric, elastomeric, or latex coating composition, thereby forming a non-foamed polymeric, elastomeric, or latex coating on the at least two regions of the former; disposing a coagulant on the non-foamed polymeric, elastomeric, or latex coating disposed on the at least two regions of the former, forming a coagulant layer on the non-foamed polymeric, elastomeric, or latex coating; dipping the coagulant coated non-foamed polymeric coating into a foamed polymeric composition, forming a foamed coating on the non-foamed polymeric, elastomeric, or latex coating; washing the foamed coating disposed on the non-foamed polymeric, elastomeric, or latex coating in water; wherein the washing step partially removes the foamed coating; and curing the non-foamed polymeric, elastomeric, or latex coating and the foamed coating in at least two steps.

Optionally, methods according to embodiments of the invention include wherein the at least two steps includes a first curing step by heating the non-foamed polymeric, elastomeric, or latex coating and the foamed coating at a first temperature and a second curing step at a second temperature, wherein the second temperature is higher than the first temperature. Furthermore, optionally, methods include wherein the first curing step includes heating the non-foamed polymeric, elastomeric, or latex coating and the foamed coating at 50-90° C. for 5-10 minutes and the second curing step includes heating the non-foamed polymeric, elastomeric, or latex coating and the foamed coating at 90-160° C. for 20 to 90 minutes.

In some embodiments of the invention, the polymeric coating 112 is foamed using air cells dispersed in the range of 5-50 volumetric percentage forming closed cells or open cells as is described in commonly-assigned U.S. Pat. Nos. 8,192,834, 8,001,809, and 7,814,571, which are herein incorporated by reference in their entireties. In some embodiments of the invention, the cells are interconnected in the polymeric layer. Closed cells provide a liquid proof polymeric coating that is highly flexible, soft and spongy, and provides good dry and wet grip. Closed cells, generally, have air content ranging from 5-15 volumetric percent. Open cells, which are interconnected, generally range from approximately 15-50 volumetric percentage range and provide a breathable glove through the foamed polymeric layer. This foamed polymeric layer may penetrate half or more of the thickness of the knitted liner, though the polymeric layer does not penetrate the entire thickness, thereby substantially avoiding strike-through, i.e., skin contact with the polymeric. A foamed polymeric composition generally has a higher viscosity and is therefore more difficult to penetrate the interstices between the yarns in the knitted liner and may require a higher depth of immersion of the former with the knitted liner.

Although a few exemplary embodiments of the invention have been described in detail above, those skilled in the art will appreciate that many modifications are possible in embodiments without materially departing from the teachings disclosed herein. Any and all such modifications are intended to be included within the embodiments of the invention, and other embodiments may be devised without departing from the scope thereof, and the scope thereof is determined by the following claims. Furthermore, it is contemplated that elements and features of one embodiment may be incorporated in other embodiments without further recitation. However, one such example is that any coagulant described herein, whether powdered, an aqueous solution, an alcoholic solution, or mixtures thereof, may be used with any knitted liner, irrespective of whether hydrophilic or hydrophobic and/or any polymeric composition.

The use of the terms "a" and "an" and "the" and other referents describing embodiments of the invention are to be contemplated both in the singular and plural unless otherwise indicated or clearly contradicted by context. Ranges of values herein are merely intended to serve as a shorthand method of referring to each separate value falling within the range; unless otherwise indicated herein, and each range value is incorporated into the specification as if individually recited herein. All methods described herein can be performed in any suitable order unless otherwise indicated herein or clearly contradicted by context. The use of any and all examples, or exemplary language (e.g., "such as") provided herein, is intended merely to better illustrate the invention and does not pose a limitation on the scope of the invention unless otherwise claimed. No language in the specification should be contemplated as indicating any non-claimed element as essential to the practice of the invention. Furthermore, the terms emulsion and composition may be used interchangeably throughout the specification. Also, the terms polymeric, latex, and elastomeric may be used interchangeably.

It is to be understood that this specification uses the terms glove and fabric liner, knitted liner, and the like, interchangeably and should be interpreted in the context that each is used. One of ordinary skill in the art will recognize that a glove may be a knitted liner, i.e., a knitted liner, having no other features, is worn as a glove. Also some gloves comprise a knitted liner having, for example, a polymeric coating disposed thereon. Yet other gloves, such as a surgical glove, i.e., an unsupported glove, are made of one or more polymeric coatings.

What is claimed is:

1. A thin, abrasion resistant supported glove, comprising:
a knitted liner comprising at least one yarn; and
a polymeric layer disposed on at least a portion of the knitted liner, the polymeric layer comprising a polymeric composition including a mixture of a nitrile-butadiene material and a water-based polyurethane material, wherein the polymeric composition has a total solids content of less than or equal to 35% and penetrates the at least one yarn approximately 50% or less of a thickness of the yarn, resulting in a thin, abrasion resistant glove.

2. The thin, abrasion resistant supported glove of claim 1, wherein the polymeric layer is capable of an EN388 abrasion level of 4 or greater.

3. The thin, abrasion resistant supported glove of claim 1, wherein the polymeric layer is approximately 0.01 to 0.02 mm in thickness.

4. The thin, abrasion resistant supported glove of claim 1, wherein the polymeric composition has a total solids content ranging from 25-30%.

5. The thin, abrasion resistant supported glove of claim 1, wherein the polymeric composition of nitrile-butadiene and polyurethane is in a ratio ranging from 50:50 to 90:10.

6. The thin, abrasion resistant supported glove of claim 1, wherein the polymeric composition further comprises an acrylic-based flow modifier.

7. The thin, abrasion resistant supported glove of claim 1, the polymeric composition further comprising at least one of natural polyisoprene, synthetic polyisoprene, non-carboxylated acrylonitrile butadiene, polychloroprene, polyvinyls, butyl latex, styrene-butadiene (SBR), styrene-butadiene latex, styrene-isoprene-styrene (SIS), styrene-ethylene/butylene-styrene (SEBS), styrene-acrylonitrile (SAN), polyethylene-propylene-diene, solvent-based polyurethane, or combinations or blends thereof.

8. The thin, abrasion resistant supported glove of claim 1, wherein the glove is capable of at least withstanding greater than 16000 revolutions in a Martindale abrasion tester without reaching the end point of the test.

9. The abrasion resistant supported glove of claim 1, wherein the glove is capable of withstanding greater than 20000 revolutions in a Martindale abrasion tester without reaching the end point of the test.

10. The thin, abrasion resistant supported glove of claim 1, wherein the polymeric composition penetrates the at least one yarn approximately 25% or less of a thickness of the at least one yarn.

11. The thin, abrasion resistant supported glove of claim 1, further comprising a small stretch delta between a portion of the knitted liner having a polymeric layer disposed thereon and a portion of the knitted liner having no polymeric layer disposed thereon.

12. A method for making a thin, abrasion resistant supported glove, comprising:
dressing a knitted liner comprising at least one yarn onto a former
disposing a coagulant solution comprising acetic acid onto the knitted liner and former;
drip-drying the knitted liner;

dipping the knitted liner and former into a polymeric composition, the polymeric composition comprising a total solids content of equal to or less than 35%, thereby disposing a polymeric coating onto the liner; and curing the polymeric coating, wherein the polymeric composition penetrates 50% or less of a thickness of the at least one yarn of the knitted liner and the polymeric coating is approximately 0.01 to 0.02 mm in thickness.

13. The method of claim 12, further comprising a second disposing step of a coagulant solution after the dipping the knitted liner step.

14. The method of claim 13, further comprising a second dipping the knitted liner and former into a polymeric composition step after the second disposing step of a coagulant solution.

15. The method of claim 12, wherein the polymeric composition comprises at least one of natural polyisoprene, synthetic polyisoprene, carboxylated acrylonitrile butadiene, non-carboxylated acrylonitrile butadiene, nitrile-butadiene, polychloroprene, polyvinyls, butyl latex, styrene-butadiene (SBR), styrene-butadiene latex, styrene-isoprene-styrene (SIS), styrene-ethylene/butylene-styrene (SEBS), styrene-acrylonitrile (SAN), polyethylene-propylene-diene, water-based polyurethane, solvent-based polyurethane, or combinations or blends thereof.

16. The method of claim 12, wherein the concentration of the coagulant solution is an aqueous acetic acid solution ranging from 30-60%.

17. The method of claim 12, wherein the polymeric composition further comprises an acrylic-based flow modifier.

18. The method of claim 12, wherein the polymeric composition of nitrile-butadiene and polyurethane is in a ratio ranging from 50:50 to 90:10.

19. The method of claim 12, wherein the polymeric composition has a total solids content ranging from 25-30%.

20. The method of claim 12, wherein the thin, abrasion-resistant supported glove comprises a small stretch delta between a portion of the knitted liner having a polymeric layer disposed thereon and a portion of the knitted liner having no polymeric layer disposed thereon.

* * * * *